US005465646A

United States Patent [19]

DiCarlo

[11] Patent Number: 5,465,646

[45] Date of Patent: Nov. 14, 1995

[54] HYDRAULIC MOTOR

[75] Inventor: Leonard J. DiCarlo, St. Louis, Mo.

[73] Assignee: McNeil (Ohio) Corporation, St. Paul, Minn.

[21] Appl. No.: 200,622

[22] Filed: Feb. 23, 1994

[51] Int. Cl.[6] ..... F01L 25/02

[52] U.S. Cl. ..... 91/308; 91/317

[58] Field of Search ..... 91/235, 280, 308, 91/317

[56] References Cited

U.S. PATENT DOCUMENTS

| | | | |
|---|---|---|---|
| 2,949,096 | 8/1960 | Ottestad et al. . | |
| 2,970,579 | 2/1961 | Paris | 91/317 |
| 3,185,040 | 4/1963 | Ligon . | |
| 3,238,850 | 10/1963 | Desmarchelier . | |
| 3,334,547 | 8/1967 | Grundmann | 91/308 |
| 3,552,269 | 3/1969 | Arndt | 91/277 |
| 3,885,454 | 5/1975 | Grieger et al. | 91/26 |
| 3,916,756 | 11/1975 | Hilton | 91/307 |
| 4,068,983 | 1/1978 | Balme et al. | 417/401 |
| 4,088,061 | 5/1978 | Stoll et al. | 91/26 |
| 4,244,274 | 5/1981 | Oguni | 91/308 |
| 4,265,164 | 5/1981 | Maeda et al. | 91/417 |
| 4,349,075 | 11/1982 | Henriksson | 173/134 |
| 4,674, 397 | 6/1987 | Wilcox | 91/235 |
| 4,794,681 | 1/1989 | Boyer et al. | 29/156.7 |
| 5,076,140 | 12/1991 | Nelsen et al. | 91/235 |
| 5,125,325 | 6/1992 | Czukkermann | 92/10 |
| 5,193,433 | 3/1993 | Reimer | 92/85 B |

FOREIGN PATENT DOCUMENTS

| | | | |
|---|---|---|---|
| 1299922 | 7/1969 | Germany | 91/317 |

*Primary Examiner*—F. Daniel Lopez

*Attorney, Agent, or Firm*—Senniger, Powers Leavitt & Roedel

[57] ABSTRACT

An improved hydraulic motor includes a cylinder having a head end and a rod end, and a piston reciprocable in the cylinder dividing it into a first expansible chamber toward the head end and a second expansible chamber toward the rod end. Fluid under pressure from a supply source is continually delivered to the second chamber. A fluid directional valve controls the delivery of fluid to and exhaust of fluid from the first chamber for reciprocating the piston within the cylinder. The piston has valving associated therewith for controlling the operation, in conjunction with a relay valve, of the fluid directional valve.

7 Claims, 5 Drawing Sheets

HYDRAULIC MOTOR

BRIEF SUMMARY OF THE INVENTION

This invention relates generally to hydraulic motors, and more particularly to a hydraulic motor of the expansible chamber type.

The invention has been developed as an improvement upon a prior hydraulic motor comprising a cylinder and a piston reciprocable in the cylinder having a trip rod housed within the piston for triggering the reversal of direction of the piston as the piston approaches an end head of the cylinder. In order to replace worn parts of the trip rod, the end heads enclosing the ends of the cylinder must be disassembled and the piston removed from the cylinder. At this point the trip rod may be removed from the piston and the worn parts may be replaced. This procedure is time-consuming and tedious. Thus, there is presently a need for a hydraulic motor having components in the form of valves for reversing the direction of the piston within the cylinder which are easily accessible and replaceable.

Among the several objects of this invention may be noted the provision of a hydraulic motor having valves of generally standard construction for reversing the direction of the piston of the motor in which the valves are easily accessible without having to disassemble the motor (i.e., remove the end heads from the cylinder and remove the piston from the cylinder); the provision of such a hydraulic motor in which the valves for reversing the direction of the piston are replaceable; and the provision of such a hydraulic motor which is economical to manufacture and efficient and durable in use.

Generally, a hydraulic motor constructed according to the principles of the present invention comprises a cylinder having a head end and a rod end, and a piston reciprocable in the cylinder dividing it into a first expansible chamber toward the head end and a second expansible chamber toward the rod end. A piston rod extends from the piston through the rod end of the cylinder. The cylinder has a transfer port at each end for delivery of pressurized fluid from a source to and exhaust of fluid from the respective chamber. The piston has a first area exposed to the pressure of fluid under pressure in the first chamber tending to drive the piston toward the rod end of the cylinder and a second and smaller area exposed to the pressure of fluid under pressure in the second chamber tending to drive the piston toward the head end of the cylinder. A hydraulic circuit includes a source of fluid under pressure and a line directly connecting the source to the transfer port at the rod end of the cylinder. Means comprising a valve controls delivery of fluid under pressure from the source through the transfer port at the head end of the cylinder and exhaust of fluid from the first chamber. The valve comprises means movable between a first position for delivery of fluid under pressure from the source to the transfer port at the head end of the cylinder and a second position for venting of fluid from the first chamber via the transfer port at the head end of the cylinder. Thus, with the valve means in its second position, fluid under pressure from the source via the transfer port at the rod end of the cylinder drives the piston toward the head end of the cylinder. Fluid is vented from the first chamber via the transfer port at the head end of the cylinder, and with the valve in its first position, fluid under pressure is delivered to the first chamber to drive the piston toward the rod end of the cylinder, with exhaust of fluid from the second chamber via the transfer port at the rod end of the cylinder. Means shifts the valve from its first to its second position in response to the piston nearing the end of its stroke in the direction toward the rod end of the cylinder, and shifts the valve from its second to its first position in response to the piston nearing the end of its stroke in the direction toward the head end of the cylinder.

Other objects and features will be in part apparent and in part pointed out hereinafter.

BRIEF DESCRIPTION OF THE DRAWINGS

Corresponding parts are designated by corresponding reference numerals in the several views of the drawings.

DETAILED DESCRIPTION OF THE PREFERRED EMBODIMENT

Figure 1:
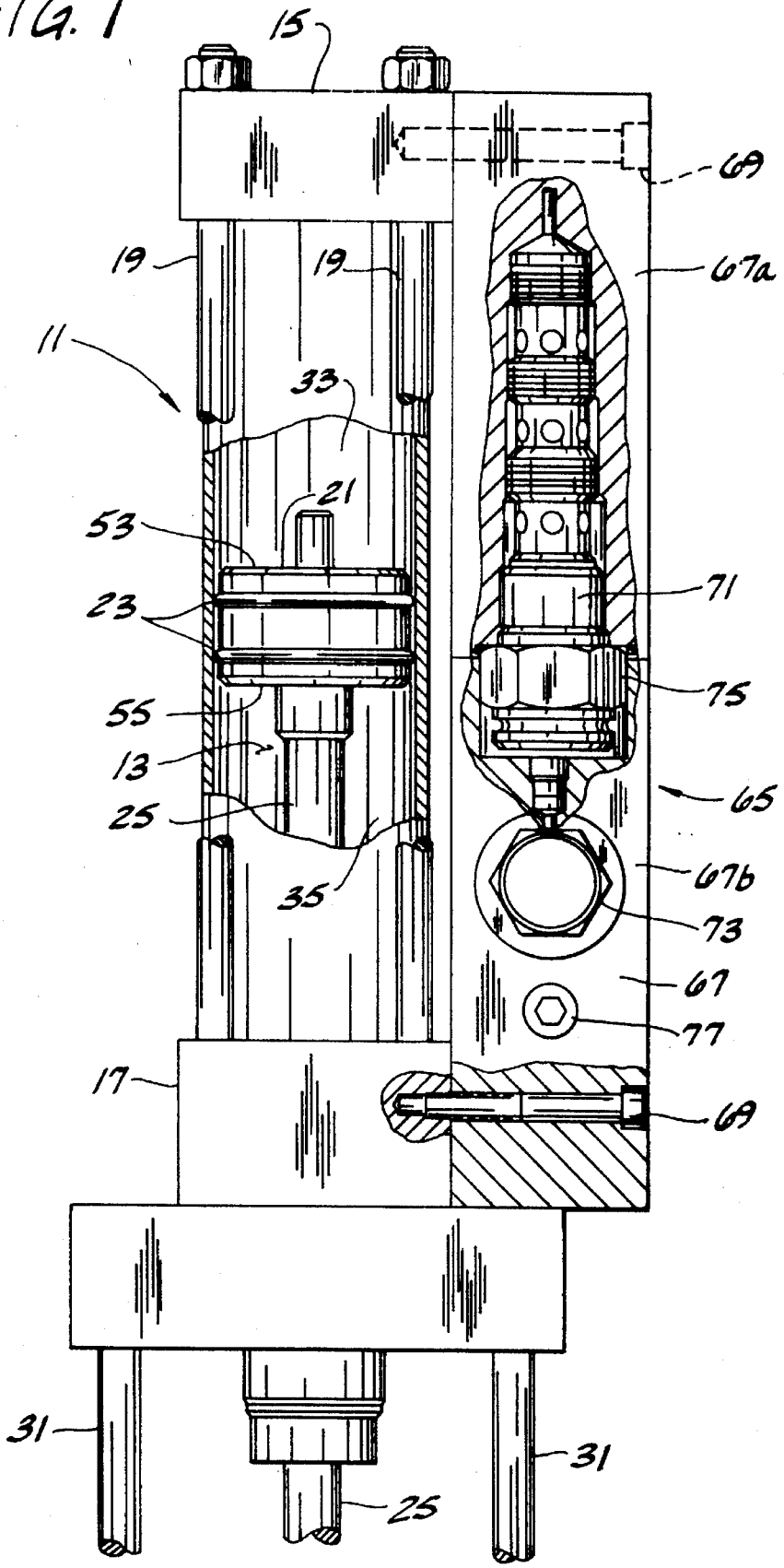
FIG. 1 is an elevational view of a hydraulic motor of the present invention with parts broken away and shown in section.

Referring to the drawings, and more particularly FIG. 1, there is generally indicated at 11 a hydraulic motor of the expansible chamber type of the present invention. As shown, this motor comprises a cylinder 13 which as generally used occupies a vertical position as shown in drawings and which has a head 15 at the upper end (the head end) of the cylinder and a rod end head 17 at the lower end (the rod end) of the cylinder. The end heads 15, 17 are secured on the upper and lower ends of the cylinder 13 by bolts or tie rods 19 as is well known in the art. A motor piston 21 is reciprocable up and down in the cylinder 13, having two O-ring seals as indicated at 23. A piston rod 25 extends down from the piston 21 through a bore 27 in the rod end head 17 (see FIG. 2). An O-ring 29 is provided in the bore 27 for sealing the rod 25 and the rod end head 17. The piston rod 25 is adapted for connection in conventional manner at its lower end to the plunger of a pump (not shown) for pumping materials such as sealants. Tie rods 31 space the motor 11 from the pump so that the rod may extend fully.

Figure 2:
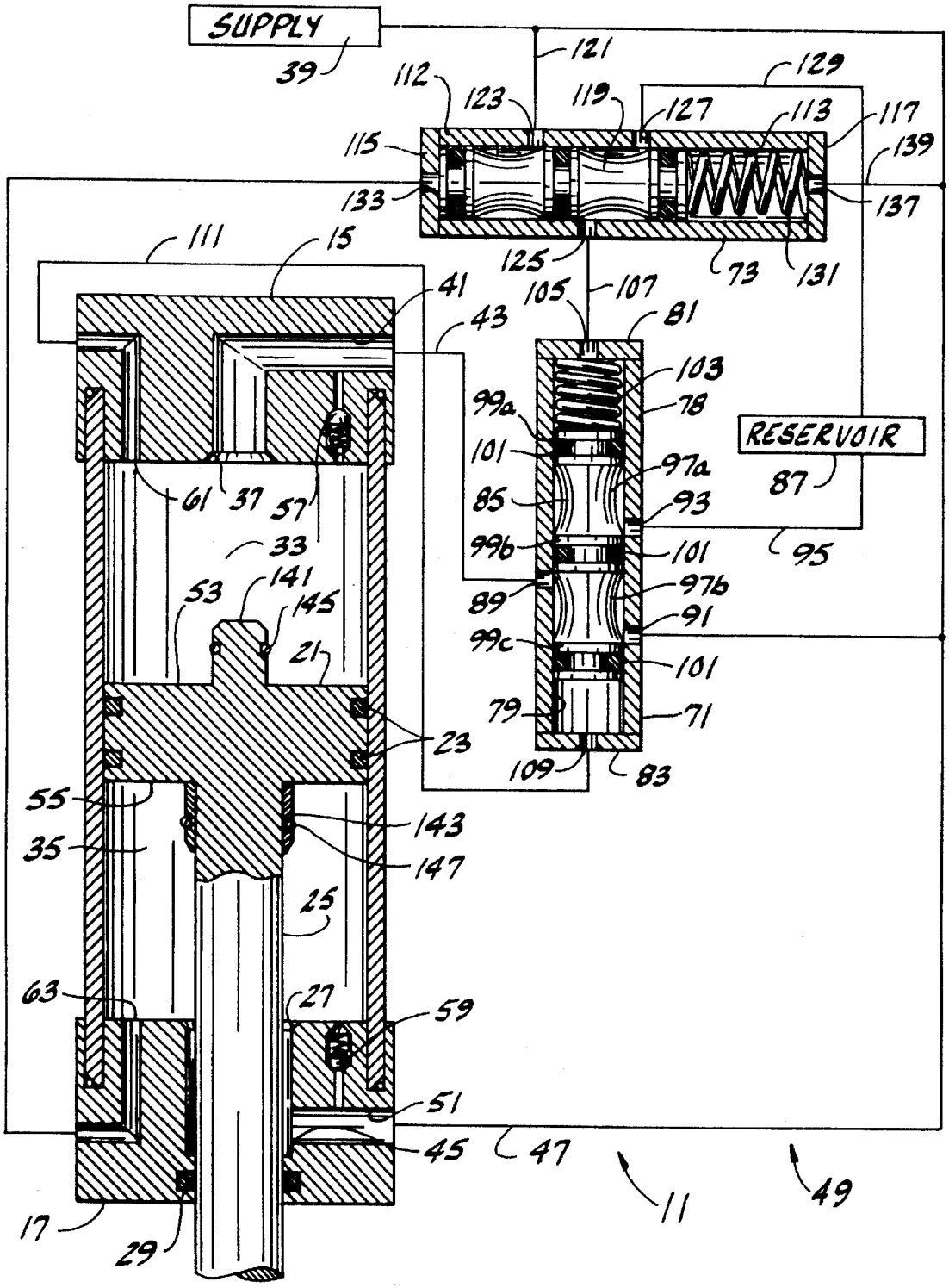
FIG. 2 is a schematic view showing the motor and valves associated therewith in section and showing the hydraulic circuitry therefor, with the piston of the motor shown in an intermediate position.
Figure 3:
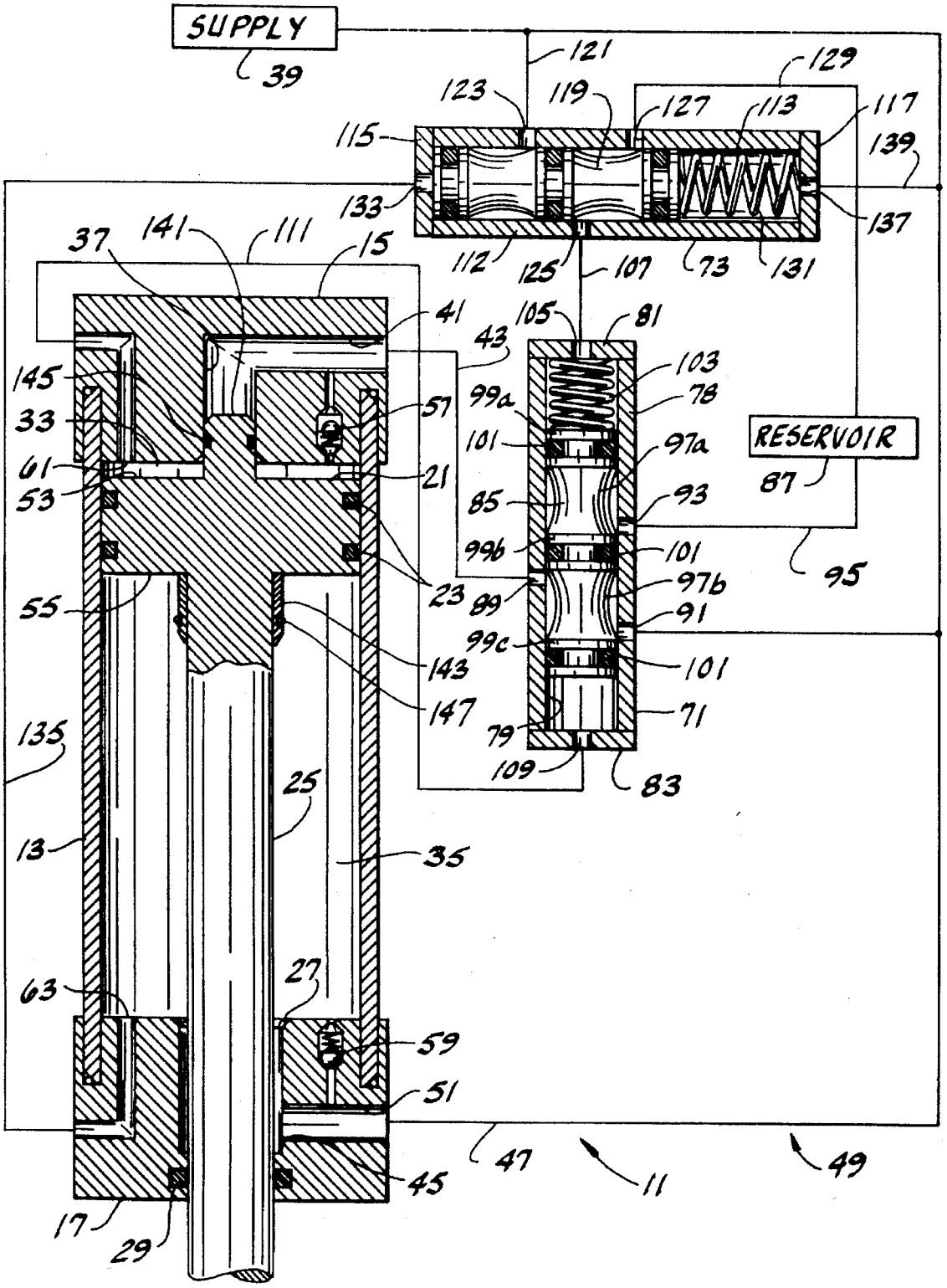
FIG. 3 is a view similar to FIG. 2 showing the piston approaching the head end of the cylinder.
Figure 4:
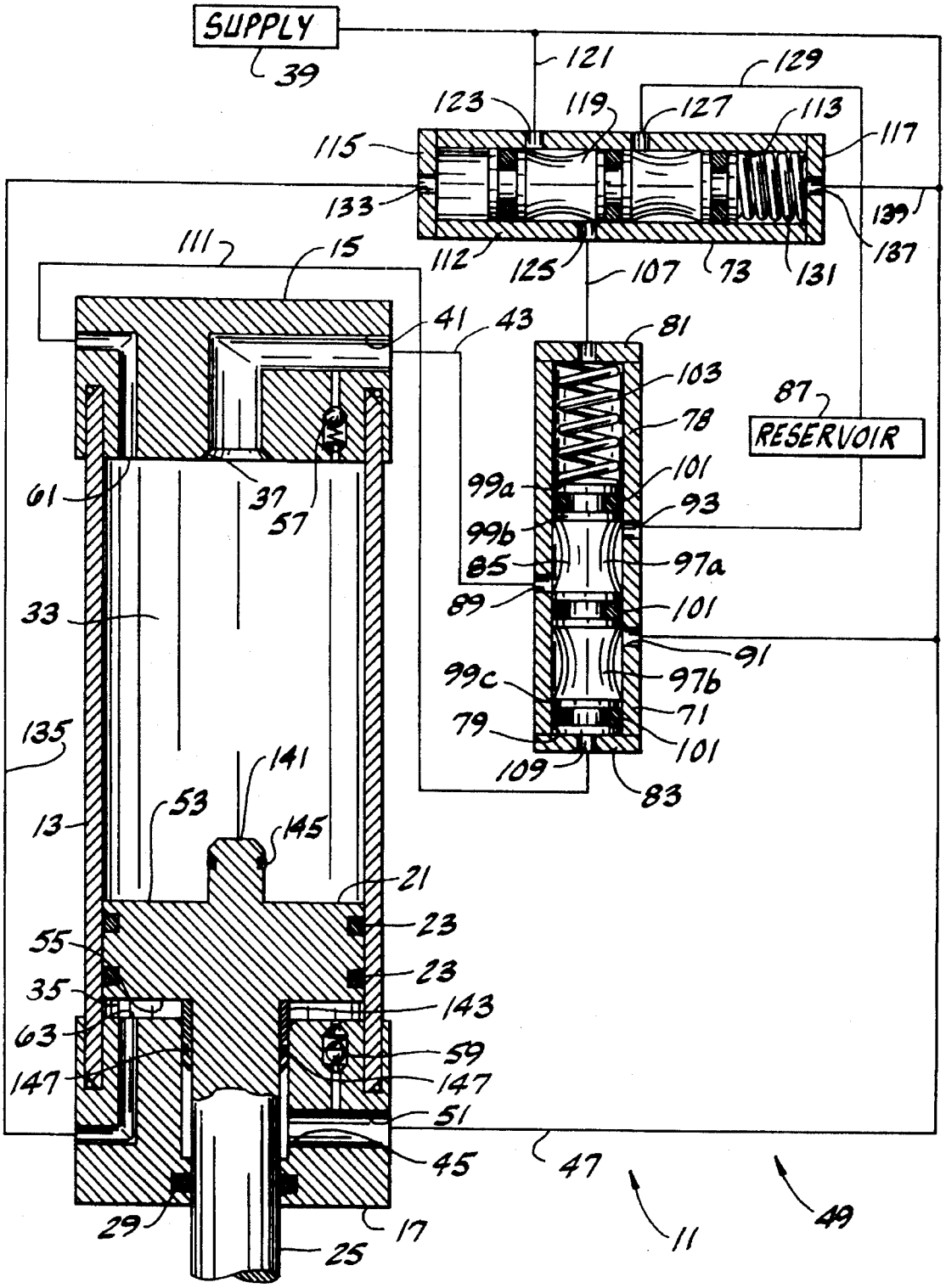
FIG. 4 is a view similar to FIGS. 2 and 3 showing the piston approaching the rod end of the cylinder.

Turning now to FIGS. 2–4, the piston divides the cylinder into a first expansible chamber designated 33 toward the head end at 15 and a second expansible chamber designated 35 toward the rod end at 17. The head 15 has a transfer port 37 centrally located therein for delivery of pressurized fluid, such as hydraulic fluid, from a supply source 39 to the first chamber 33 and for exhaust of fluid from the chamber. The transfer port 37 has a circular cross section. A passageway 41 in the head 15 connects the transfer port 37 to a line 43. Likewise, the bore 27 at rod end head 17 is centrally located in the rod end head for passage of the rod therethrough and has a circular cross section. The bore 27 is in fluid communication with a transfer port 45 for delivery of fluid under pressure from the supply source 39 to the second chamber 35 and for exhaust of fluid therefrom (i.e., against the flow of fluid from the supply source). The bore 27 has a portion of greater diameter than that of the piston rod 25 which terminates short of the portion of the bore with O-ring 29 so that fluid may pass from the second chamber 35 to the transfer port 45. A hydraulic line 47, forming part of a hydraulic circuit generally indicated at 49, provides fluid communication between the supply source 39 and the transfer port 45 at the rod end 17 of the cylinder 13. Thus, the second chamber 35 is supplied with pressurized fluid at all times except when the transfer port 45 at the rod end 17 is blocked. A passageway 51 connects the transfer port 45 at the rod end 17 to the line 47.

As illustrated in FIGS. 2–4, the piston 21 has a first or upper area 53 exposed to the pressure of fluid in the first chamber 33. Pressure applied to the upper area 53 tends to drive the piston 21 toward the rod end 17 of the cylinder 13. The piston 21 also has a second or lower area 55 which is smaller than the upper area 53 (because of the piston rod 25) and exposed to the pressure of fluid in the second chamber 35. Pressure applied to the lower area 55 tends to drive the piston toward the head end 15 of the cylinder 13. The upper area 53 of the piston 21 is approximately two times greater than the lower area 55 of the piston.

Each of the head and rod ends 15, 17 has a check valve therein, these valves being designated 57, 59, respectively. Check valve 57 is in fluid communication with passageway 41 at the head end 15 and check valve 59 is in fluid communication with passageway 51 at the rod end. The purpose of check valves 55, 57 will be discussed hereinafter. Each of the head and rod ends 15, 17 also has an exhaust port therein, these ports being designated 61, 63, respectively, for exhaust of pressurized fluid from the respective chamber.

Figure 5:
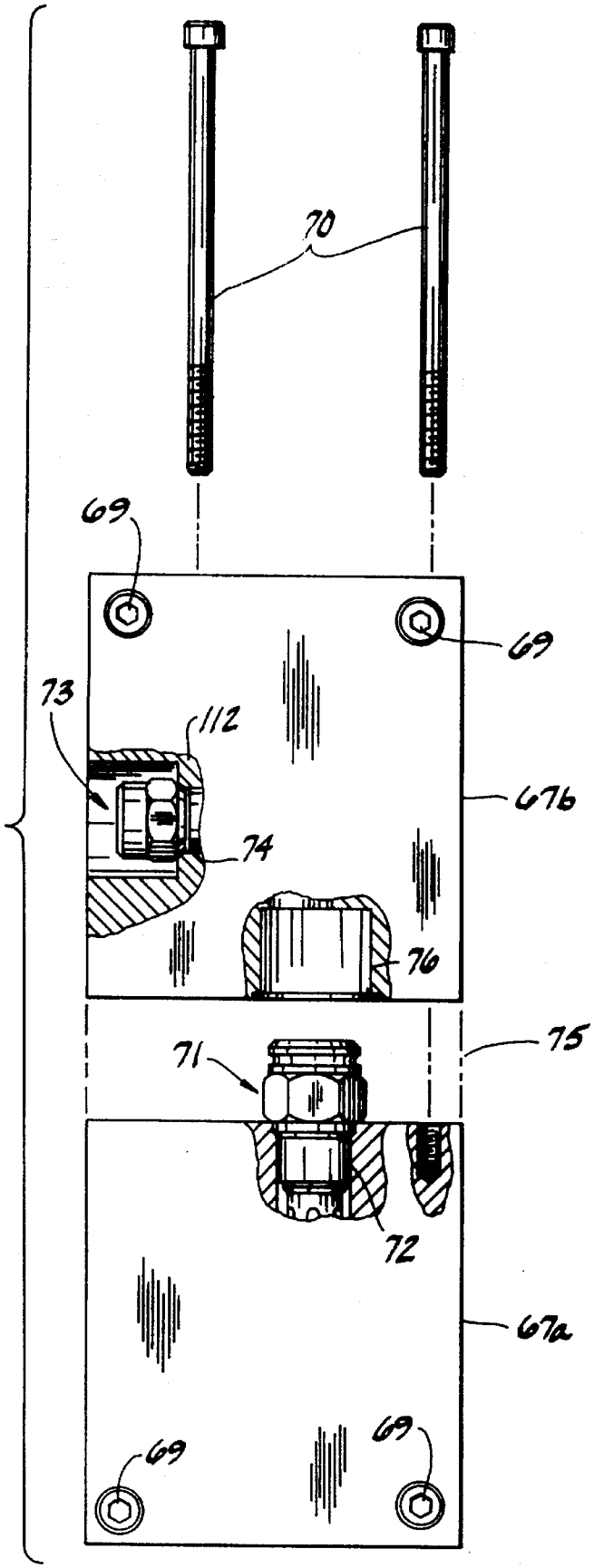
FIG. 5 is an exploded view of a two-piece block housing the circuitry of the invention.

Referring back to FIG. 1, means for controlling delivery of fluid under pressure from the supply source 39 through the transfer port 37 at the head end 15 of the cylinder 13 to the first chamber 33 and exhaust of fluid from the first chamber is generally designated 65. This controlling means comprises an elongate metal block 67 (e.g., a cast aluminum block) suitably secured to the side of the cylinder 13 as shown in FIG. 1 by screws 69. The metal block 67 houses a fluid directional valve 71 which controls the delivery of fluid to and the exhaust of fluid from the first chamber 33, and a relay valve 73 which controls the operation of the fluid directional valve. As illustrated in FIGS. 1 and 5, the metal block 67 is formed of two pieces **67*a*, 67*b* attached at 75 in a suitable manner (e.g., by bolts 70) such that the fluid directional valve 71 is embedded within the block and the relay valve 73 is accessible at the side of the block. Both the fluid directional valve 71 and the relay valve 73 are threadedly secured in the block 67 in a suitable manner, the fluid directional valve 71 being threadedly secured at 72 to piece 67*a* and the relay valve being threadedly secured at 74 to piece 67*b*. A recess 76 is formed in piece 67*b* for receiving the head of the fluid directional valve 71 therein when attaching pieces 67*a* and 67*b* together. To replace a worn fluid directional valve 71, the block 67 need only be removed from the side of the cylinder 13 and the two pieces 67*a*, 67*b* forming the block separated so that the end of the fluid directional valve is exposed. The block 67 also has plugged passaging, such as the passaging indicated at 77**, where passaging within the block is provided and sealed by plugs from atmosphere.

Referring now to FIGS. 2–4, the fluid directional valve 71 comprises a body 78 having a cylindric bore 79 and end heads 81 and 83 closing the ends of the bore, end head 81 constituting the upper end head of bore 79 and end head 83 constituting the lower end head thereof. A valve spool 85 is axially slidable in the bore 79 between a first position toward the upper end head 81 of the body as shown in FIGS. 2 and 3, for effecting delivery of pressurized fluid from the supply source 39 to the first chamber 33 of the cylinder 13 for driving the piston 21 down, and a second position toward the lower end head 83 of the body as shown in FIG. 4 for effecting exhaust of fluid from the first chamber 33 to a reservoir 87 of supply fluid for effecting the upward movement of the piston 21 in the cylinder 13. Line 43 connects the passageway 41 of the end head 15 and a port 89 in the body 78 of the fluid directional valve 71. Pressurized fluid is supplied from the supply source 39 to a supply port 91 in the body 78 which is in communication with the port 89 and line 43 when the valve spool 85 is in its first position (FIG. 3). At 93 is indicated an exhaust port in body 78 in communication with the bore 79 and with the reservoir 87 via line 95. When the valve spool 85 of the fluid directional valve 71 is in its second position (FIG. 4), fluid from the first chamber 33 is exhausted by line 43 through ports 89 and 93 of the bore 95 to line 79 which is connected to reservoir 87.

The valve spool 85 is constructed as illustrated with annular grooves such as indicated at **97*a* and 97*b* between lands 99*a*, 99*b*, and 99*c* to establish communication between ports 89 and 91 when in its first position (FIGS. 2 and 3) and to establish communication between ports 89 and 93 when in its second position (FIG. 4). The lands 99*a*, 99*b*, 99*c* have seals such as indicated at 101. A spring 103 in the bore 79 at the upper end head 81 of the valve 71 biases the valve spool 85 down to its second position (FIG. 4**).

With the spool 85 of the fluid directional valve 71 in its second position (FIG. 4), fluid under pressure in the second chamber 35 drives the piston 21 up toward the head end 15 of the cylinder 13. Fluid in the first chamber 33 is vented through the transfer port 37 at the head end 15 of the cylinder 13 via passage 41 and lines 43 and 95 to the reservoir. With the fluid directional valve 71 in its first position, fluid under pressure is delivered to the first chamber 33 from the supply source 39 via lines 47 and 43 to drive the piston 21 down toward the rod end 17 of the cylinder 13 since the force of fluid in the first chamber 33 on the upper area 53 of the piston 21 is greater than the force of fluid in the second chamber 35 on the lower and smaller area 55 of the piston. As mentioned above, fluid in the second chamber 35 flows through the transfer port 45 at the rod end 17 against supply fluid being delivered thereto.

The valve spool 85 of the fluid directional valve 71 is movable from its first position of FIGS. 2 and 3 to its second position of FIG. 4 on delivery of pressurized fluid to the upper end of the bore 79 of the valve through a port 105 provided at said upper end in fluid communication with the relay valve 73 via a line 107, and is movable back to its first position on delivery of fluid to the lower end of the bore 79 through a port 109 provided therein in fluid communication with the first chamber 33 via the exhaust port 61 in the upper end head 15 of cylinder 13 and a line 111, and exhaust of fluid above the spool through port 105 to the reservoir. Spring 103 is of sufficient strength to bias the valve spool 85 down to its second position (FIG. 4) upon delivery of pressurized fluid to the upper end of the bore 79, but of low enough strength so that the valve spool 85 moves up to its first position (against the bias of the spring) upon pressurized fluid being delivered to the lower end of the bore 79 and the upper end of the bore being vented to the reservoir 87.

The supply of pressurized fluid to and exhaust of fluid from the upper end 81 of the bore 79 of the fluid directional valve 71 are controlled by the relay valve 73 which comprises a cylindrical body 112 having an axial bore 113 therein, left- and right-hand end heads 115 and 117 and a valve spool 119 slidable in the bore between a first position (FIG. 4) toward the right end head 117 of the valve and a second position (FIGS. 2 and 3) toward the left end head 115 of the valve. In its first position, the valve spool 119 of the relay valve 73 delivers fluid under pressure from the supply source 39 to the upper end of the bore 79 of the fluid directional valve 71 to move the fluid directional valve down to its second position. Pressurized fluid is delivered to the relay valve 73 via line 121 through port 123. A port 125 of the relay valve is in fluid communication with line 107 which is connected to the port 105 in the upper end head 81 of the fluid directional valve 71. In its second position, the valve spool 119 of the relay valve 73 exhausts fluid from the upper end head 81 of the fluid directional valve 71. Fluid above the valve spool 85 of the fluid directional valve 71 is exhausted via line 107, through port 125 and an exhaust port 127, and to a line 129 which is connected to the reservoir 87 of supply fluid for moving the fluid directional valve to its first position.

The relay valve 73 is of similar construction to that of the fluid directional valve 71 in that a spring 131 biases the valve spool 119 to its second position (FIGS. 2 and 3), and upon delivery of fluid to the left-hand end head 115 of the valve 73 from the second chamber 35 of the cylinder, the valve spool moves to its first position (right-hand position as shown in FIG. 4). The left-hand end head 115 of the valve 73 has a port 133 connected to a line 135 which establishes communication between the second chamber 35 of the cylinder 13 and the left-hand end of the bore of the relay valve via port 63. The right-hand end head 117 of the relay valve 73 has a port 137 in communication with a line 139 connected to the supply source 39. Thus, upon delivery of fluid from the second chamber 35 to the left-hand end of the bore 113, the valve spool 119 moves to the right against the bias of the spring 131 and the force applied to the right-hand end of the valve spool by the pressurized fluid of the supply source to its first position.

Means of the present invention for shifting the fluid directional valve 71 from its first to its second position in response to the piston 21 nearing the end of its stroke to fully extend the rod (i.e., its downstroke) in the direction toward the rod end 17 of the cylinder 13, and for shifting the valve 71 from its second to its first position in response to the piston 21 nearing the end of its stroke (its upstroke) in the direction toward the head end 15 of the cylinder 13 embodies first and second valve members or plugs 141, 143 (broadly "first and second valve means") which block the transfer port 37 and bore 27 at the head and rod ends, respectively. Plugs 141, 143 have seals 145, 147, respectively, for sealing the respective transfer port 37 and bore 27 from their respective chambers.

The first plug 141 is provided on the upper face 53 of the piston 21 projecting from the piston toward the head end 15 of the cylinder 13. As shown, the plug 141 may be formed integral with the piston 21. Upon entering the transfer port 37 of the head end 15, the plug 141 seals the transfer port from the first chamber 33 somewhat before the piston reaches the head end during its stroke to fully retract the rod (i.e., its upstroke). Fluid in the first chamber 33 is thereby prevented from entering the transfer port 37 at the head end 15. The fluid in the first chamber 33 is thereupon exhausted through the exhaust port 61 of the head end and delivered to the lower end of the fluid directional valve 71 for shifting the valve to its first position (FIG. 2) whereupon pressurized fluid from the supply source 39 is delivered to the first chamber 33 for reversing the direction of the piston 21 (i.e., moving the piston down).

Similarly, the second annular plug 143 is disposed around the rod 25 and mounted thereto adjacent the lower face 55 of the piston 21 projecting from the piston down toward the rod end 17 of the cylinder 13. Plug 143 may be a separate member which is attached to the piston 21 and rod 25 as by welding, for example. Upon entering the bore 27 of the rod end 17 (and thereby blocking the transfer port 45 of the rod end), the second plug 143 seals the bore 27 from the second chamber 35 somewhat before the piston 21 reaches the rod end 17 during its downstroke. Fluid in the second chamber 35 is thereby prevented from entering the transfer port 45 at the rod end 17. The fluid in the second chamber 35 is thereupon exhausted through the exhaust port 63 of the rod end and delivered to the left-hand end of the bore 113 of the relay valve 73 for shifting the relay valve to its first (right-hand FIG. 4) position. Fluid is thereby delivered from the supply source 39 to the upper end of the bore 79 of the fluid directional valve 71 thereby shifting the valve down to its second position (FIG. 4) in which fluid from the first chamber 33 is exhausted for reversing the direction of the piston 21 (i.e., moving the piston up).

The check valves 57, 59 facilitate the reversal of direction of the piston 21. Check valve 57, in a passage interconnecting chamber 33 and passageway 41 in the head end 15, is a one-way check valve which prevents fluid in the first chamber 33 from entering passageway 41, but allows fluid under pressure in the passageway to enter the first chamber after the piston has completed its stroke (i.e., when plug 141 is blocking transfer port 37). Upon movement of the fluid directional valve 71 to its first position and delivery of pressurized fluid from the supply source 39 to the first chamber 33, pressurized fluid is delivered to the first chamber via the check valve 57 (see FIG. 3) to initially move the piston 21 downwardly until the first plug 141 exits the transfer port 37 of the head end 15. Similarly, check valve 59 in a passage interconnecting chamber 35 and passageway 51 in the rod end 17 is also a one-way check valve which prevents fluid in the second chamber 35 from entering the passageway 51, but allows fluid under pressure in the passageway to enter the second chamber 35 after the piston 21 has completed its stroke. Upon movement of the fluid directional valve 71 to its second position coupled with the delivery of pressurized fluid from the supply source 39 to the second chamber 35, pressurized fluid is delivered to the second chamber 35 via the check valve 59 (see FIG. 4) to initially move the piston 21 upwardly until the second plug 143 is removed from the bore 27 at the rod end 17.

A summary of the operation of the hydraulic motor 11 is as follows. When the piston 21 is approaching the rod end 17 of the cylinder 13, fluid under pressure from the supply source 39 is being delivered to the first chamber 33 and fluid in the second chamber 35 is being exhausted through the bore 27 and the transfer port 45 of the rod end via line 47 against the flow supply of fluid from the supply source. Even though pressurized fluid is being delivered to both chambers 33, 35, the piston 21 moves downward since the upper area 53 of the piston 21 is greater than its lower area 55, the pressure of fluid in chambers 33, 35 being equal. Before completing its full downstroke movement, the second plug 143 of the piston 21 enters the bore 27 of the rod end 17 thereby blocking the transfer port 45 of the rod end and the exhaust of fluid from the second chamber 35 therethrough. Fluid in the second chamber 35 is thus exhausted through the exhaust port 63 of the rod end 17 and delivered to the left-hand end of the bore 113 of the relay valve 73 via line 135. The valve spool 119 of the relay valve 73 is thereby moved to its first position (FIG. 4) in which fluid from the supply source 39 is delivered to the upper end of the bore 79 of the fluid directional valve 71. The movement of the relay valve 73 from its second to first position need only be momentary since the delivery of fluid under pressure to the upper end of the bore 79 of the fluid directional valve 71 shifts and maintains (by spring 103) the valve spool 85 of the fluid directional valve in its second position. Upon shifting the fluid directional valve 71 to its second position, fluid from the first chamber 33 is exhausted therefrom to the reservoir 87 via the fluid directional valve. Now that the first chamber 33 is vented, pressurized fluid may be delivered to the second chamber 35 through the check valve 59 of the rod end 17 to move the piston 21 upwardly.

As the piston 21 approaches the head end 15 of the cylinder 13, the first plug 141 enters the transfer port 37 of the head end 15 of the cylinder 13 to block the exhaust of fluid from the first chamber 33 to the reservoir 87 via the fluid directional valve 71. Fluid in the first chamber 33 is thus exhausted through the exhaust port 61 of the head end 15 and delivered to the lower end of the bore 79 of the fluid directional valve 71. By this time, the valve spool 119 of the relay valve 73 has moved back to its second position to vent fluid from the upper end of the bore 79 of the fluid directional valve 71. Thus, in response to pressurized fluid being delivered from chamber 33 via line 111, the valve spool 85 of the fluid directional valve 71 moves to its first position against the bias of spring 103 for delivering pressurized fluid from the supply source 39 to the first chamber 33. Fluid is thereby delivered to the first chamber 33 through the check valve 57 of the head end 15 to move the piston 21 downwardly.

It will be observed that if either the fluid directional or relay valves fail, they may be easily replaced. To replace the fluid directional valve 71, the block 67 mounted on the side of the cylinder 13 is removed by unscrewing bolts 69 which mount it on the cylinder. The two pieces **67*a*, 67*b* forming the block 67 are separated by unscrewing bolts 70, and the fluid directional valve 71 may be unscrewed and removed from piece 67*a*. A new fluid directional valve may then be screwed into piece 67*a*, threads being provided in the bore at 72 to threadedly engage the threads of the valve, and the two pieces joined together at 75 and secured to one another by bolts 70. To remove the relay valve 73, it may be accessed without having to remove the block 67 from the cylinder 13 and unscrewed as the fluid directional valve 71. Thus, to replace the items most likely to wear out due to use (i.e., the fluid directional and relay valves), the head and rod ends 15, 17 of the cylinder 13** do not need to be removed as with the reciprocable hydraulic cylinders of the prior art.

In view of the above, it will be seen that the several objects of the invention are achieved and other advantageous results attained.

As various changes could be made in the above constructions without departing from the scope of the invention, it is intended that all matter contained in the above description as shown in the accompanying drawing shall be interpreted as illustrative and not in a limiting sense.

What is claimed is:

1. A hydraulic motor comprising a cylinder having a head end and a rod end, a piston reciprocable in the cylinder dividing it into a first expansible chamber toward the head end and a second expansible chamber toward the rod end, a piston rod extending from the piston through the rod end of the cylinder, the cylinder having a transfer port at each end for delivery of pressurized fluid from a source to and exhaust of fluid from the respective chamber, the piston having a first area exposed to the pressure of fluid under pressure in the first chamber tending to drive the piston toward the rod end of the cylinder and a second and smaller area exposed to the pressure of fluid under pressure in the second chamber tending to drive the piston toward the head end of the cylinder, a hydraulic circuit including a source of fluid under pressure and a line directly connecting said source to the transfer port at the rod end of the cylinder, means comprising a valve for controlling delivery of fluid under pressure from said source through the transfer port at the head end of the cylinder and exhaust of fluid from the first chamber, said valve of the controlling means comprising means movable between a first position for delivery of fluid under pressure from said source to the transfer port at the head end of the cylinder and a second position for venting of fluid from said first chamber via said transfer port at the head end of the cylinder, whereby with said valve of the controlling means in its second position, fluid under pressure from said source via said transfer port at the rod end of the cylinder drives the piston toward the head end of the cylinder, fluid being vented from the first chamber via the transfer port at the head end of the cylinder, and with said valve of the controlling means in its first position, fluid under pressure is delivered to said first chamber to drive the piston toward the rod end of the cylinder, with exhaust of fluid from said second chamber via said transfer port at the rod end of the cylinder, means for shifting the said movable means of the valve of the controlling means from its first to its second position in response to the piston nearing the end of its stroke in the direction toward the rod end of the cylinder, and shifting the said movable means of the valve of the controlling means from its second to its first position in response to the piston nearing the end of its stroke in the direction toward the head end of the cylinder, said cylinder having an exhaust port at each end for exhaust of pressurized fluid from the respective chamber, said shifting means comprising first valve means for blocking the transfer port at the head end of the cylinder before the piston reaches the head end during its stroke to fully retract said rod, whereby when said first valve means is blocking the transfer port of the head end of the cylinder, the fluid in the first chamber is exhausted through the exhaust port of the head end of the cylinder and delivered to said valve of the controlling means for shifting the said movable means of said valve of the controlling means to its first position thereby delivering pressurized fluid from said source to the first chamber for reversing the direction of the piston, wherein said shifting means further comprises a relay valve for operatively shifting the said movable means of the valve of said controlling means, and second valve means for blocking the transfer port of the rod end of the cylinder before the piston reaches the rod end of the cylinder during its stroke to fully extend said rod, whereby when said second valve means is blocking the transfer port of the rod end of the cylinder, the fluid in the second chamber is exhausted through the exhaust port of the rod end of the cylinder and delivered to said relay valve for delivery of fluid under pressure from said source to said valve of the controlling means thereby shifting the said movable means of said valve of the controlling means to its second position in which fluid from the first chamber is exhausted for reversing the direction of the piston.

2. A hydraulic motor as set forth in claim 1 wherein said second valve means comprises a second plug projecting from the piston towards the rod end of the cylinder, said second plug being adapted to seal the transfer port of the rod end of the cylinder from the second chamber before the piston reaches the rod end during its stroke to fully extend said rod so that fluid in said chamber is prevented from entering the transfer port.

3. A hydraulic motor as set forth in claim 2 wherein said transfer port of the rod end of the cylinder is in fluid communication with a bore in the rod end provided for receiving said rod, and wherein said second plug is an annular member disposed around said rod and adapted to seal said bore from the second chamber.

4. A hydraulic motor as set forth in claim 1 wherein said relay valve of said shifting means controls the movement of the said movable means of said valve of the controlling means between its first and second positions, said relay valve being movable between a first position for delivery of fluid under pressure from said source to said valve of the controlling means for shifting the said movable means of said valve of the controlling means to its second position, and a second position for exhaust of fluid from said valve of the controlling means allowing a shift of the said movable means of said valve of the controlling means to its first position.

5. A hydraulic motor as set forth in claim 4 wherein said valve of the controlling means comprises a valve spool constituting said movable means axially slidable within a bore between first position in which said valve delivers fluid under pressure fluid from said source to the transfer port of the head end of the cylinder and into the first chamber and a second position in which said valve exhausts fluid from said first chamber, said valve spool of the valve of the controlling means being adapted to shift to its second position in response to fluid under pressure being delivered by said relay valve and being adapted to shift to its first position in response to pressurized fluid being delivered from the first chamber through the exhaust port of the head end of the cylinder when said first valve means blocks the transfer port of the head end of the cylinder.

6. A hydraulic motor as set forth in claim 5 wherein said relay valve comprises a of said valve of the controlling means spool axially slidable within a bore between a first position in which fluid under pressure from said source is delivered to said valve of the controlling means for moving the valve spool of the valve to its second position, and a second position for moving the valve spool of the valve of the controlling means to its first position, said valve spool of the relay valve being adapted to shift to its stated first position for delivering fluid under pressure from said source to said valve in response to fluid being delivered from the second chamber through the exhaust port of the rod end of the cylinder when said second valve means blocks the transfer port of the rod end of the cylinder.

7. A hydraulic motor as set forth in claim 1 wherein the head and rod ends of the cylinder each has a one-way check valve therein for supplying fluid under pressure from said source of fluid under pressure to the respective chamber after said piston has completed its stroke.

* * * * *